United States Patent [19]

Schulte et al.

[11] Patent Number: 4,689,454

[45] Date of Patent: Aug. 25, 1987

[54] ELECTRICAL PUSH BUTTON SWITCH HAVING A SPLASH-PROOF CYLINDRICAL ENCLOSURE

[75] Inventors: Siegfried Schulte; Manfred Böing, both of Lüdenscheid, Fed. Rep. of Germany

[73] Assignee: Schulte-Elektrotechnik GmbH & Co. KG, Fed. Rep. of Germany

[21] Appl. No.: 751,057

[22] Filed: Jul. 2, 1985

[30] Foreign Application Priority Data

Jul. 7, 1984 [DE] Fed. Rep. of Germany ..... 3425097
Oct. 30, 1984 [DE] Fed. Rep. of Germany ..... 3439695
Mar. 26, 1985 [DE] Fed. Rep. of Germany ..... 3510875

[51] Int. Cl.[4] ..... H01H 13/52

[52] U.S. Cl. ..... 200/159 A; 200/340; 200/302.2

[58] Field of Search ..... 200/159 A, 287, 302.2, 200/304, 340

[56] References Cited

U.S. PATENT DOCUMENTS 3,255,333 6/1966 Schuchard ..... 200/340
3,586,810 6/1971 Brown ..... 200/302.2
3,818,169 6/1974 Kobernus ..... 200/159 A
3,819,891 6/1974 Miller et al. ..... 200/302.2
4,225,758 9/1980 Kondo et al. ..... 200/159 A
4,251,723 2/1981 Speidel et al. ..... 200/340

FOREIGN PATENT DOCUMENTS 2717139 11/1978 Fed. Rep. of Germany ... 200/159 A
3230414 2/1984 Fed. Rep. of Germany .
553665 5/1943 United Kingdom ..... 200/302.2
480127 11/1975 U.S.S.R. ..... 200/340

*Primary Examiner*—Stephen Marcus
*Assistant Examiner*—Renee S. Luebke
*Attorney, Agent, or Firm*—Bacon & Thomas

[57] ABSTRACT

An electrical push button switch having a cylindrical enclosure with a base in which pairs of contacts are located. A push button is guided in this cylindrical enclosure having one contact spring for each pair of contacts. The design ensures that the push button switch is splash-proof with an almost integral serviceable assembly and that with this assembly, the switch can be designed not only for normally opened, but also for normally closed functions. The base is formed in one piece as main element of the enclosure and has an interior chamber at both sides of which the contacts are arranged. Each contact spring has resilient legs which are adjacent to the contacts in one switch position and which are separated from the contacts in the other switch position.

18 Claims, 15 Drawing Figures

FIG. 5
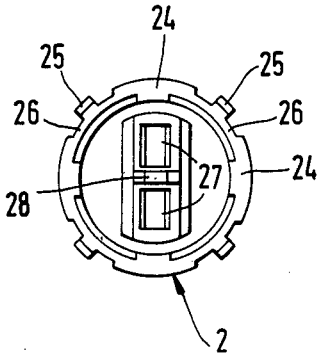
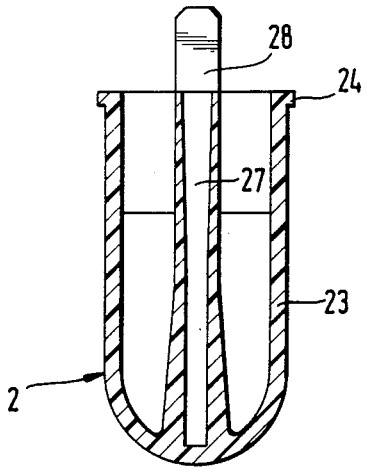
FIG. 4
FIG. 8
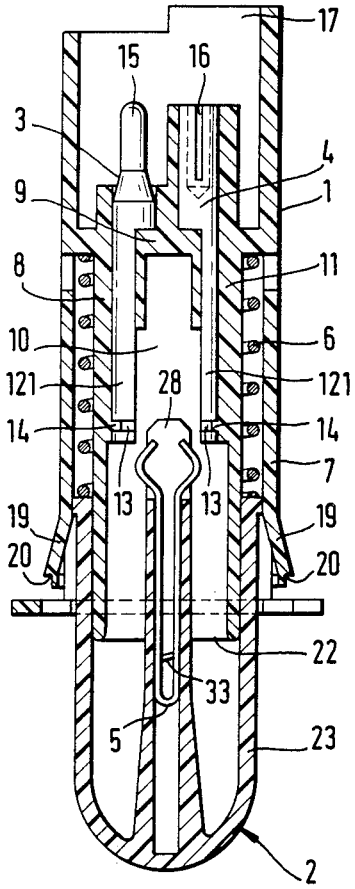

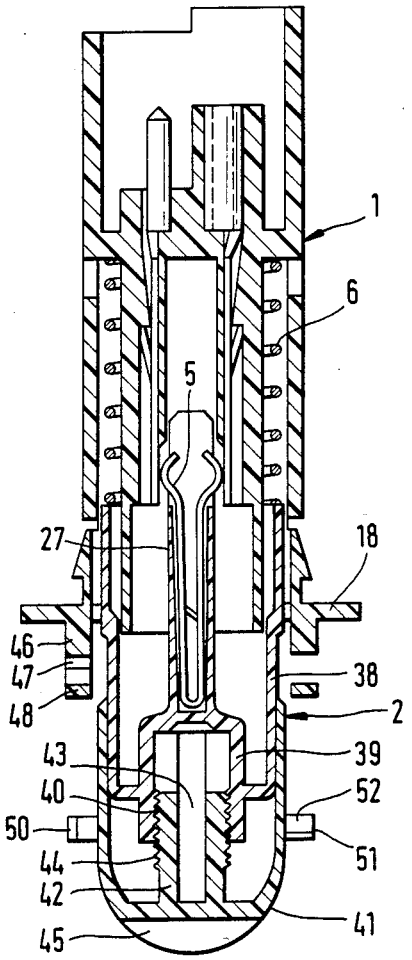
FIG. 9
FIG. 10
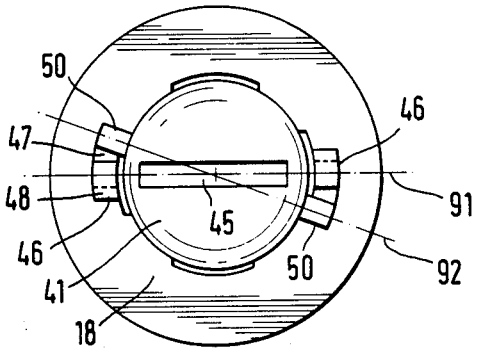
FIG. 11
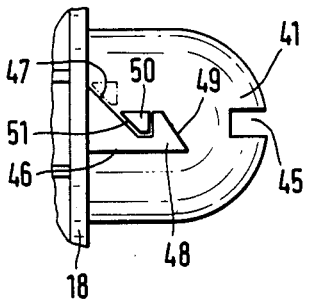

FIG.14
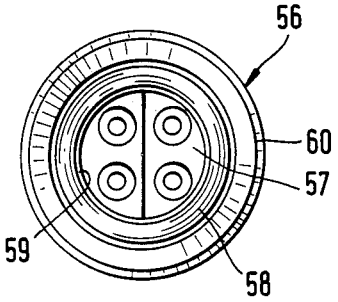
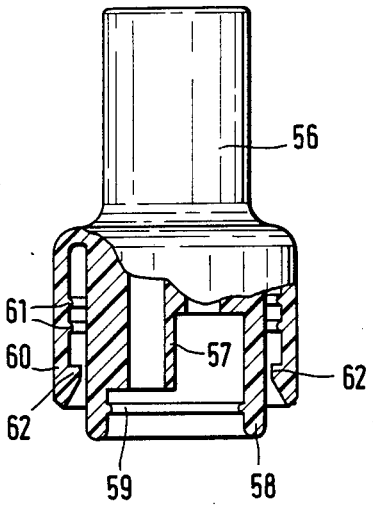
FIG.13
FIG.12
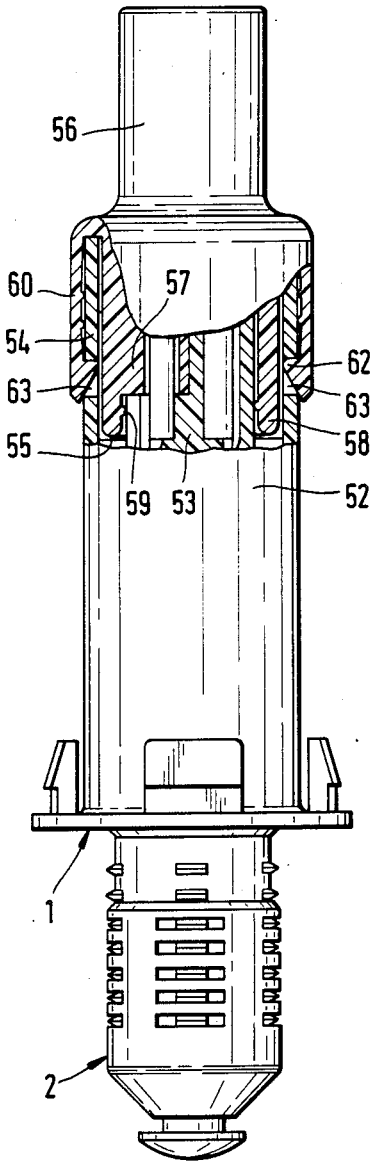

ELECTRICAL PUSH BUTTON SWITCH HAVING A SPLASH-PROOF CYLINDRICAL ENCLOSURE

BACKGROUND OF THE INVENTION

1. Field of the Invention

The invention relates to an electrical push button switch comprising a cylindrical enclosure having a base with pairs of contacts and comprising further a push button guided in this cylindrical enclosure, containing one contact spring each for every pair of contacts.

2. Description of the Prior Art

The field of application for such a push button is especially found in switching on the illumination in the interior of motorcars by opening the doors, and switching on the illumination of the truck by opening the truck cover or similar switch functions.

Usual switches of this kind need an enclosure, a separate base arranged in the enclosure and a sealing means in order to obtain a splash-proof assembly. For this reason three basic elements for the enclosure are necessary which also have to be assembled.

SUMMARY OF THE INVENTION

Object of this invention is the design of a splash-proof push button having a nearly integral, serviceable construction.

The object is solved by this invention in that the base is formed in one piece as a main element of the enclosure and has an interior chamber defining recesses at both sides in which the contacts are arranged. Every contact spring comprises spread out legs which are adjacent to the contacts in one switch position and which are separated from the contacts in the other switch position.

The push button according to this invention differs in an extraordinary way from the prior art as the base and the enclosure are formed by one integral element. According to this invention the enclosure can be designed in such a way to provide splash-proof protection without any additional means. Only the contact elements with the contacts are inserted in the enclosure. The mounting of any further enclosure elements is unnecessary. The push button is pressed into the enclosure and is engaged there. Therefore the energy expended on the mounting is extremely low.

In order to obtain maximum splash-proof protection the invention provides that the enclosure has an inner sleeve which surrounds the main element further has an outer shell such that the push button is guided into an annular space between the inner sleeve and the outer shell.

A correct guidance of the push button and a non-destructive disassembly is achieved by forming the outer surface with several longitudinal slots distributed in a circumferential direction and the push button with wall sections directed towards the longitudinal slots, the thickness of which is less then the width of the annular space and which have locking noses engaging the slots.

In order to guarantee a high electrical insulation value inside the contact chamber, the push button has a separation tongue at both sides of which a contact spring is arranged so as to extend into the interior chamber of the base. Two pairs of contact elements are arranged in the base.

For fixing the contact springs without additional auxiliary means in the reception chamber, it is provided that every contact spring has two spread-out legs and that a clamping stud is cut free and bent off out of one leg which passes through a window of the other leg.

The opening of the push button switch is ensured by the fact that the spread-out legs are adjacent to the contacts during the unoperated position of the push button and that the spread-out legs are adjacent to the chamber walls of the base on pressing the push button.

The closing function of the push button is ensured by the fact that the spread-out legs are spread out freely during the unoperated position of the push button and stand before the front ends of the contacts and will be adjacent to them by pressing on the push button.

The invention provides that the enclosure has a flange and in an axial distance of it, elastic tensile tongues projecting outside are arranged for fixing the push button switch in a mounting plate.

In order to fix the contacts in their recesses the contacts have a peripheral groove each at the front ends, engaging a shoulder of the respective recess.

In order to automatically adjust the push button, it is provided that the push button comprises a base with a reception sleeve having an axial profile and a push button cap which engages a profiled stud in the profile of the reception sleeve. For this action the adjusting elements are not necessary. During the first operation of the switch the contact travel or the contact point is adjusted automatically by the sliding of the push button cap.

A further development of this invention provides that the reception sleeve has an internal thread and that the stud of the push button cap is provided with an external thread. This enables a loosening or removing of the push button cap at any time.

The pressing of the push button cap is made easier by providing the pin and/or the sleeve with a slot in an axial plane. Due to this, elastic deformations might occur on pressing the push button cap.

As a further development of this invention, radially projecting locking noses are provided on the push button cap and locking profiles for engagement with the locking noses are provided on the enclosure. This makes it possible to arrest the push button switch for tests, service and adjustments.

An automatic unlocking of the catch is ensured by providing each locking profile with a lateral face rising in a circumferential direction adjacent a hooked head, the top side of which rises in the same way as the rising lateral face.

Damage of the arresting equipment resulting from an unfavourable position of the arresting noses is prevented by the underside of the locking nose rising in the same way as the top side of the head. As a result of this, the push button cap is always guided over the top side of the head of the locking profile.

A complete water proof and dust proof sealing is obtained by an inserted socket; a collar, and a plug with a plug insert which may be plugged in the socket insert and a plug collar, overlapping the socket insert. The outer sleeve and the plug insert are formed from an injection moulded part of one piece. The interior diameter of the outer sleeve and the external diameter of the socket collar are the same and sealing rings are moulded at the interior wall of the outer sleeve.

The enclosure of the plug is formed as one piece together with the exterior sleeve. A very high removal resistance is obtained because the exterior sleeve is fixed elastically on the socket collar. The sealing off against dust and moisture is increased considerably.

A further modification provides that the push button is provided with a base having profiled strips running in an axial direction on the circumferential surface and further a push button with clicking studs which are provided as strips.

A further modification provides that the profiled strips are sawtooth-shaped.

For the protection of the cap it is provided that the push button cap overlaps an elastic protection cap and is clamped onto a holding plate.

The sealing of the cap is further promoted in that the closed outer surface receives guiding studs of the push button in longitudinal guides.

BRIEF DESCRIPTION OF THE DRAWING

Embodiments of the invention are explained with reference to the enclosed drawings:

FIG. 4 is a sectional view of the push button, FIG. 5 is a top view of FIG. 4, FIG. 8 is a sectional view of a second embodiment of a push button switch which is designed as a closing contact, FIG. 9 is a sectional view of a third embodiment of a push button switch, FIG. 10 is a bottom view of the switch shown in FIG. 9, FIG. 11 is a partial side view of the switch shown in FIG. 10, FIG. 12 is a side view partially in section of a fourth embodiment, of the push button switch, FIG. 13 is a partial sectional view of the plug part of the embodiment shown in FIG. 12, FIG. 14 is a front view of the plug part shown in FIG. 13.

DESCRIPTION OF THE PREFERRED EMBODIMENTS

Figure 3:
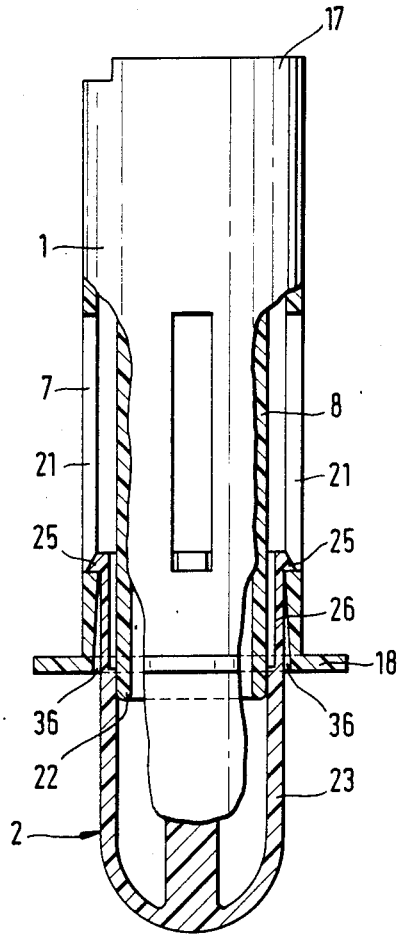
FIG. 3 is a partial sectional view taken along line III—III of FIG. 2.

The push button switch described in FIGS. 1–7 has an opening function with normally-closed contacts. The push button switch comprises an enclosure 1, a push button 2, two contact springs 5 which are each coordinated to a pair of contact elements 3, 4 and one helical compression spring 6 for resetting the push button 2.

The enclosure 1 is formed as an injection moulded part comprising an outer shell 7, an inner sleeve 8 and a base 9. This complete assembly is formed as one single thermoplastic injection moulded part. The base 9, which is the main element of the enclosure 1, has an inner chamber 10 with a nearly rectangular cross-section (see especially the right half of FIG. 2). On the opposite side of the inner chamber 10, recesses 11 are defined in the walls 37 for the contacts 12 of the contact elements 3, 4. Each contact element 3, 4 has a semi-cylindrical contact 12 which is pressed into the recesses 11. In the area of the front end of the contact 12 one peripheral groove 13 is provided in which a ring-shaped shoulder 14 of the respective recess 11 or the inner sleeve is engaged. At their front ends the contact elements 3 have male plug pins 15, and the contact elements 4 have female plug portion bushes 16. The enclosure 1 ends in a stepped plug collar 17 for the reception of the counterpart of the plug, see FIG. 12. This arrangement of plug and plug pins is standardized.

The outer shell 7 has a flange 18 which enables the mounting of the enclosure 1 in a mounting plate, not-shown. Axially spaced from the flange 18, the outer shell 7 defines barbed tensile tongues 19 directed outwardly each of which is provided with steps 20. These tensile tongues resiliently retreat on inserting the enclosure 1 into the mounting plate and clamp the edges of an opening for mounting. The steps 20 enable adaptation to different thicknesses of the mounting plates.

The outer shell 7 also defines longitudinal slots 21. The represented embodiment provides four such longitudinal slots, each displaced by 90° in a circumferential direction. The inner sleeve 8 surpasses the height of the flange 18 with a collar 22 in order to guarantee a good guidance for the push button 2 and to make the switch splash proof. Directed towards the longitudinal slots 21 and in order to obtain axial guidance, the internal surface of the outer shell 7 has widened portions 36 the use of which will be explained later.

A detailed description of the push button 2 is given in the FIGS. 4 and 5. The push button 2 has a cylindrical surface 23 with flange sections 24 and locking noses 25 formed on the front end. In the area of the locking noses 25 specific wall sections 26 have a smaller thickness than the width of the annular space between the inner sleeve 8 and the outer shell 7 of the enclosure 1. Due to this reduced thickness the surface 23 of the push button 2 is easily deformable in the area of these wall sections 26.

Two rectangular reception chambers 27 are provided in the interior space of the push button 2, which are separated from each other by means of a separation tongue 28. This separation tongue 28 extends beyond the end faces of the outer surface 23.

Figure 6:
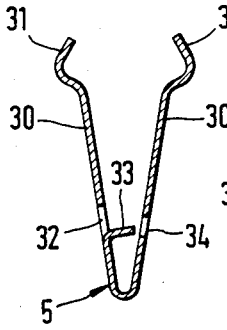
FIG. 6 is a sectional view of a contact spring.
Figure 7:
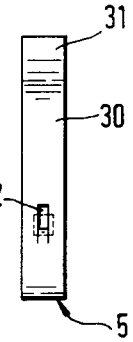
FIG. 7 is a side view of the contact spring of FIG. 6.
Figure 2:
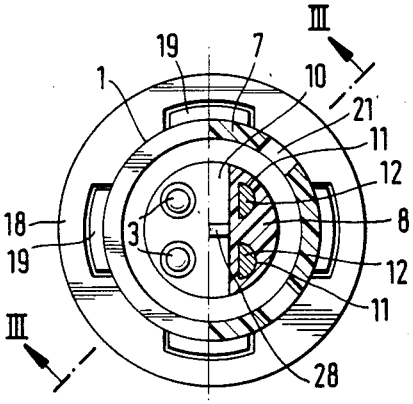
FIG. 2 is a sectional view taken along line II—II of FIG. 1.

Each reception chamber 27 receives a contact spring 5, which is described in detail in FIGS. 6 and 7. Every bow-shaped contact spring 5 is equiped with two diverging legs 30, each ending in a curved section 31 with a contact area. A window 32 is cut out in one leg 30 from which a clamping stud 33 is bent off. A further window 34 is punched out in the opposite leg 30. The clamp stud 33 is directed towards the window 34 and passes through the window 34 if the legs ae pressed together.

Figure 1:
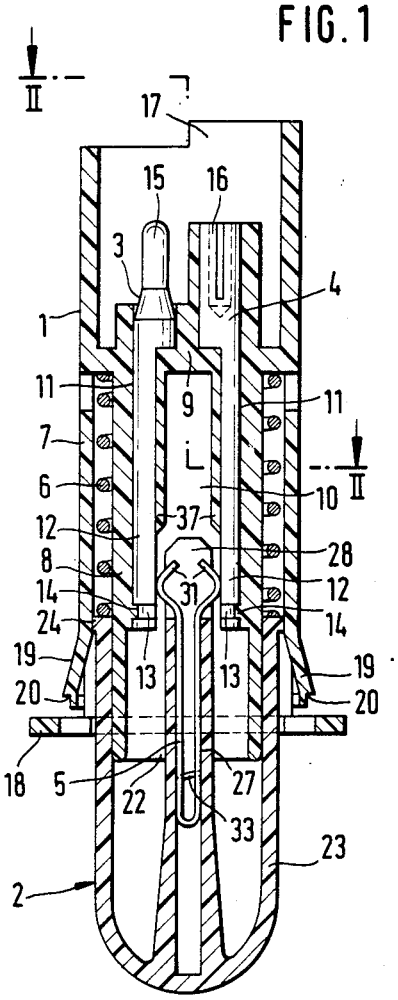
FIG. 1 is a sectional view of the push button switch according to the invention.

Each contact spring 5 is pressed into the reception chamber 27 of the push button as can be seen in FIG. 1. The clamping stud 33 is supported by the walls of the reception chamber and secures the contact spring 5 in the reception chamber 27 in a safe and non-removable manner.

The restoring force for the push button 2 is supplied by a helical compression spring 6, which is situated in the annular space between the inner sleeve 8 and the outer shell 7 of the enclosure 1.

Push button 2 may be assembled to the enclosure 1 after: the contact elements 3 and 4 have been pressed into the recesses 11 of the base 9 in the interior of the enclosure 1 and engaged in the circumferential grooves 13; the helical compression spring 6 has been put in the annular space between the inner sleeve 8 and the outer shell 7; and the contact springs 5 have been pressed into the reception chambers 27 of the push button 2. The push button switch is readily assembled by pressing the push button 2 in the annular space between the interior sleeve 8 and the outer shell 7. Due to this function the locking noses 25 are guided in the widened portions 36 of the annular space, enabling the locking noses 25 to be inserted into the longitudinal slots 21. On pressing in, the thin wall sections 26 are deformed enabling the locking noses 25 to engage in the longitudinal slots 21. After this procedure the push button switch is in the assembled position according to FIGS. 1 and 3. The push button remains unoperated in this position. The curved sections 31 touch the pieces 12 under yielding contact, and both circuits are closed. During the operation of the push button switch by pressing the push button 2, the curved sections 31 touch the walls 37 of the interior chamber 10, and as a result, the legs 30 are pressed together. By these means the curved sections 31 are raised from the pieces 12. The electrical circuits are then interrupted.

The flange sections 24 of the push button 2 guide the push button during the movement on the inner side of the outer shell 7 enabling an easy guidance.

FIG. 8 shows an embodiment of the push button switch as closing contact with normally open contacts. In this case the contacts 121 are shorter than the previous embodiment. Therefore the curved sections 31 are expanded freely along with the legs 30. The curved sections 31 are displaced from the contacts 121. Only during pressing of the push button 2 do the curved sections 31 engage the contacts 121 and close the electrical circuits.

The embodiments of the push button according to FIGS. 9–11 allows an automatic adjustment of the switching operation or the switching point. Within the cylindrical enclosure 1 the push button 2 is arranged so as to be displaceable in the axial direction against the effect of the helical compression spring 6. The enclosure 1 is provided with a flange 18 for assembling the enclosure in an aperture of a mounting plate. The enclosure 1 receives the electrical contacts and connecting parts in a base part that has been described in detail in connection with the before mentioned embodiment.

A sleeve-shaped bottom part 38 of the push button 2 defines reception chambers 27 for the contact springs 5. At the front end the bottom part 38 defines a reception sleeve 39 with an internal thread 40. A push button cap 41 engaging in the reception sleeve 39 with a pin 42 fastened to the push button 2. The pin 42 is provided with a longitudinal slot 43 and an external thread 44. The longitudinal slot is found also in the reception sleeve 39. A transverse slot 45 is provided in the head surface of the push button cap in which a tool for turning the push button cap 41 can be engaged.

The flange 18 of enclosure 1 is provided with locking profiles 46. Every locking profile 46 is provided with a lateral surface 47, rising in circumferential direction, and an adjacent hook-shaped head 48 the top 49 of which rises in the same direction and to some extent parallel to the lateral surface 47. This embodiment provides two locking profiles 46 which ae arranged opposite to each other. Nevertheless any other number of locating profiles is possible.

Radially projecting locking noses 50 are provided on the push button cap 41, the bottom side 51 of which rises in the same direction as the lateral surface 47 and the top 49.

The function and the method of operation of this push button switch is as follows: First, push button cap 41 is loosely attached to the bottom part 38. The enclosure 1 is mounted in the reception aperture by installing the flange 18 there in the usual, known way. An adjustment of the push button cap 41 to the switching operation is not necessary. During the first operation of the push button switch, the push button cap 41 is pushed on the opposite element and moves inside of the reception sleeve 39. In the final position the push button cap 41 is directed exactly to the switching operation. This displacement is possible due to the deformation of the pin 42. During this procedure the threads act as axial profiles. Therefore the push button switch is adjusted exactly to the switching operation.

A blade-shaped tool or a coin can be inserted into the transverse slot 45 and the push button cap 41 can be screwed out in case the push button switch has to be adjusted.

For maintenance, for functional tests and for other works the push button switch can be blocked by inserting the locking nose 50 under the head 48 of the locking profile as shown in FIG. 11. A turning of the push button cap 41 is possible due to the engagement of the threads. Nevertheless the switch is kept in a blocked position when the transverse slot 45 is in the direction of line 91.

Any loosening of the lock is impossible. During the first following operation of the switch the push button cap 41 is pressed further in an axial direction. As a result of this the push button cap 41 is turned by engagement of the bottom side 51 of every locking nose with the lateral surface 47 with a screwing movement. The transverse slot 45 is turned as a result of this to the direction of line 92. Finally the push button switch is functionally complete because the locking noses can move unrestrictedly along the locking profiles. Due to the fact that the top side 49 of the head 48 has a corresponding rising as well, the locking noses 50 are always guided safely over the head 48. As a result of this it is impossible that the locking noses 50 touch the top side of the head 48 and jam there. Therefore it is impossible to damage the switch.

The FIGS. 12–15 show a further embodiment of a push button switch 1 with an integral socket 52. The socket 52 comprises a socket insert 53 which receives the plug sleeves and plug pins for a commonly used plug system. The socket insert 53 is surrounded by a socket collar 54, an annular recess 55 between the socket insert 53 and the socket collar 54 being provided.

A plug 56 for a line terminal comprises a plug insert 57 which also receives plug sleeves and plug pins and which corresponds to the plug insert 53. A plug collar 58 with a ring-shaped seal 59 is moulded in one piece onto the interior wall of the plug insert. Further an exterior sleeve 60 is provided in one piece with the plug 56 which overlaps the socket collar 54 and the interior diameter of which corresponds nearly to the exterior diameter of the socket collar 54. Circumferential sealing rings 61 are provided in the interior wall of the exterior sleeve 60. Locking noses 62 of the exterior sleeve 60 engage apertures 63 defined by the socket collar 54. The plug 56 with the plug insert 57, the plug collar 58 and with the exterior sleeve 60 is moulded as a one-piece thermoplastic part of a high-strength, but elastic thermoplastic material.

A push button switch 1 of the described kind finds its application for instance in motor cars and is installed in a wall of the car body. The plug 56 is plugged onto the socket 52. The exterior sleeve 60 is clamped in the socket collar 54. Especially in the region of the sealing rings 61 the exterior sleeve 60 is widened elastically, providing there a high tension.

Due to its dimensioning the front edge of the exterior sleeve 60 touches the circumference of the socket collar 54, as it can be seen from FIG. 12. The concave-shaped curve of the exterior sleeve 60 can be recognized easily. The plug coupling guarantees a high resistance against dis-engagement as the exterior sleeve 60 provides a large bearing surface at the socket collar 54 and as a result of this a high friction. Further high moisture-proof and dust-proof characteristics are achieved by the strongly moulded exterior sleeve 60.

Figure 15:
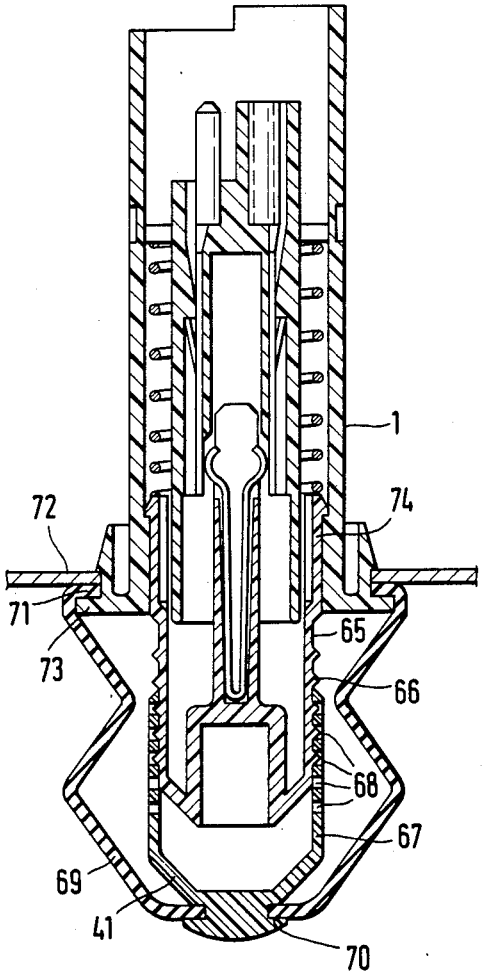
FIG. 15 is a sectional view of the push button switch shown in FIG. 12.

According to FIGS. 12 and 15 the base 65 of the push button 2 has profiled and sawtoothed strips 66 running in an axial direction. Several rows of such strips are distributed over the circumference of the outer surface. The push button cap 41 has clicking studs 67 with apertures 68 for engagement with the sawtoothed strips 66. Said elements allow an adjustment of the switching operation.

An elastic protective cap 69 surrounds the push button cap 41. Said protective cap 69 is snapped into a circumferential groove 70 in the push button cap 41. A front flange 71 is fixed between holding plate 72 and a flange 73 of the enclosure 1. Guiding studs 74 of the push button cap 41 engage guidance slots of the enclosure 1.

We claim the following:

1. A splash-proof push button electrical switch comprising:

(a) a generally cylindrical enclosure having an integral base, an integral sleeve defining an inner chamber, and an integral outer shell extending around the inner sleeve so as to define an annular space therebetween, the outer shell defining at least one longitudinal slot;

(b) at least one pair of electrical contacts attached to the base;

(c) a push button having a generally cylindrical portion slidably received in the annular space of the cylindrical enclosure, at least one locking nose formed on the cylindrical portion so as to engage the longitudinal slot; and at least one reception chamber for receiving a contact spring;

(d) at least one contact spring attached to the push button in the reception chamber for each pair of electrical contacts, the contact spring having: two diverging contact legs such that the legs engage the electrical contacts in a first position of the push button and are out of engagement with the electrical contacts in a second position of the push button; an opening through one of the contact legs; and a clamping, stud extending from the other of the contact legs so as to pass through the opening when the contact spring is inserted into the reception chamber, and, (e) a helical compression spring located in an annular space between the inner sleeve and the outer shell and bearing against the generally cylindrical portion of the push button.

2. An electrical push button switch according to claim 1 wherein: the outer shell defines a plurality of longitudinal slots, distributed in circumferential direction; a plurality of locking noses are formed on the cylindrical portion; and wherein the cylindrical portion of the push button defines reduced thickness wall sections adjacent to each of the locking noses.

3. An electrical push button switch according to claim 1, wherein the push button further comprises: a central portion having a separation tongue; two pairs of electrical contacts attached to the base; and, a pair of contact springs, one contact spring located on each side of the separation tongue.

4. An electrical push button switch according to claim 1, wherein the two diverging legs are disengaged from the electrical contacts during the unoperated position of the push button and are brought into contact with them by pressing the push button.

5. An electrical push button switch according to claim 1 wherein the generally cylindrical enclosure defines a socket insert and a surrounding socket collar and further comprising: a plug having an integrally formed plug insert which may be plugged in the socket insert; an integrally formed plug collar, extending around the socket insert; and an integrally formed exterior sleeve extending around the plug collar wherein an interior diameter of the exterior sleeve and an external diameter of the socket collar are the same and wherein sealing rings are moulded on an interior wall of the outer sleeve.

6. An electrical push button switch according to claim 1, wherein the push button further comprises: a base having profiled strips extending in an axial direction from an exterior circumferential surface; and strips of clicking studs on the push button.

7. An electrical push button switch according to claim 6, wherein the profiled strips are sawtooth-shaped.

8. An electrical push button switch according to claim 7, further comprising an elastic protection cap clamped onto a holding plate and overlapping the push button.

9. An electrical push button switch according to claim 8, further comprising: a plurality of guiding studs formed on the push button base; and, a plurality of longitudinal guidance slots defined by the generally cylindrical enclosure to receive guiding studs of the push button.

10. An electrical push button switch according to claim 1, wherein the two diverging legs are in contact with the electrical contacts in the unoperated position of the push button and wherein the two diverging legs in contact with walls of the inner chamber on pressing the push button.

11. An electrical push button switch according to claim 10 further comprising: a flange attached to the enclosure; and a plurality of outwardly projecting elastic tensile tongues axially displaced from the flange arranged for fixing the push button switch in a mounting plate.

12. An electrical push button switch according to claim 11, wherein the electrical contacts each define a peripheral groove adjacent one end; and a shoulder formed on the enclosure so as to engage the peripheral grooves to retain the electrical contacts in the base.

13. An electrical push button switch according to claim 12, wherein the push button comprises: a base portion having a reception sleeve with internal retention means; and a push button cap having a pin with external retention means which engages the internal retention means formed on the reception sleeve.

14. An electrical push button switch according to claim 13, wherein internal retention means on the reception sleeve comprises an internal thread and wherein the external retention means on the pin of the push button cap comprises an external thread.

15. An electrical push button switch according to claim 14, wherein at least the pin or the sleeve defines a slot extending in an axial plane.

16. An electrical push button switch according to claim 15, wherein radially projecting second locking noses are provided on the push button cap, and wherein locking profiles for engagement with the second locking noses are provided on the generally cylindrical enclosure.

17. An electrical push button switch according to claim 16, wherein: each locking profile defines a lateral face rising in circumferential direction; and an adjacent hooked head, a top side of which is generally parallel to the rising lateral face.

18. An electrical push button switch according to claim 17, wherein an underside of the second locking nose is generally parallel to the top side of the hooked head.

* * * * *